US006908277B2

(12) United States Patent
Jacobsson

(10) Patent No.: US 6,908,277 B2
(45) Date of Patent: Jun. 21, 2005

(54) SPEED GOVERNOR FOR A PNEUMATIC ROTATION MOTOR

(75) Inventor: Rolf Alexis Jacobsson, Saltsjö-Boo (SE)

(73) Assignee: Atlas Copco Tools AB, Nacka (SE)

( * ) Notice: Subject to any disclaimer, the term of this patent is extended or adjusted under 35 U.S.C. 154(b) by 191 days.

(21) Appl. No.: 10/451,348

(22) PCT Filed: Dec. 20, 2001

(86) PCT No.: PCT/SE01/02834

§ 371 (c)(1),
(2), (4) Date: Jun. 18, 2003

(87) PCT Pub. No.: WO02/052127

PCT Pub. Date: Jul. 4, 2002

(65) Prior Publication Data

US 2004/0040295 A1 Mar. 4, 2004

(30) Foreign Application Priority Data

Dec. 22, 2000 (SE) ..... 0004841

(51) Int. Cl.[7] ..... F01D 17/06

(52) U.S. Cl. ..... 415/43; 415/151; 415/144; 415/202; 137/50; 251/30.03; 251/30.05; 251/61.2

(58) Field of Search ..... 415/42, 43, 144, 415/151, 202; 137/50; 251/30.02, 30.03, 30.05, 61.2

(56) References Cited

U.S. PATENT DOCUMENTS

| | | | | |
|---|---|---|---|---|
| 3,198,954 A | | 8/1965 | Eggenberger et al. | |
| 3,410,030 A | | 11/1968 | McHenry et al. | |
| 3,446,483 A | | 5/1969 | Townsend | |
| 3,923,429 A | | 12/1975 | Schaedler et al. | |
| 4,465,443 A | * | 8/1984 | Karden | 418/43 |
| 4,746,808 A | * | 5/1988 | Kaeser | 290/52 |

* cited by examiner

*Primary Examiner*—Edward K. Look
*Assistant Examiner*—Devin Hanan
(74) *Attorney, Agent, or Firm*—Frishauf, Holtz, Goodman & Chick, P.C.

(57) ABSTRACT

A speed governor for a pneumatic rotation motor having a pressure air inlet passage (15, 15'), an inlet valve (16; 56) including a flow controlling valve element (18; 58) located in the inlet passage (15, 15'), and a speed responsive activating device (24; 54) operatively connected to the inlet valve (16; 56), wherein the activating device (24, 54) comprises a pilot circuit with an activating surface (20; 70) on the valve element (18; 58), a restricted air supply opening (21, 72) communicating with the activating surface (20; 70), a bleed-off valve (24; 54) which communicates with the activating surface (20; 70) and which comprises an electro-magnet actuator (27; 76), and a generator (30) driven by the motor and delivering to the actuator (27; 76) a voltage of a magnitude responsive to the actual motor speed to thereby make the bleed-off valve (24; 54) operate in response to the output voltage of the generator (30) and the actual motor speed.

12 Claims, 1 Drawing Sheet

SPEED GOVERNOR FOR A PNEUMATIC ROTATION MOTOR

This application is a U.S. National Phase Application under 35 USC 371 of International Application PCT/SE01/02834 filed Dec. 20, 2001.

The invention relates to a speed governor for a rotation motor having a rotor and a stator with a pressure air inlet passage, wherein the governor comprises a flow controlling inlet valve with a valve element disposed in the inlet passage, and a speed responsive activating device operatively connected to the inlet valve.

In particular, the invention concerns an improved speed governor suitable for fast rotating motors where conventional type speed governors are difficult to use due to high centrifugal forces and occurring balancing problems. Conventional speed governors are also mechanically rather complicated and are difficult to make operate in a safe way unless they are of a certain size. This, in turn, makes it difficult to obtain an accurate and safe speed governor operation at small size motors, for instance in hand held power tools, where the available space for a speed governor is very limited.

The above mentioned problems are avoided by a governor according to the invention wherein a pressure air inlet valve is controlled by an electrically governed pneumatic pilot circuit which includes an electromagnet actuated bleed-off valve which is activated by a motor speed responsive output voltage of a motor driven generator.

Further characteristic features and advantages of the invention will appear from the following specification and claims.

A preferred embodiment of the invention is described below in detail with reference to the accompanying drawings.

On the drawings

Figure 1:
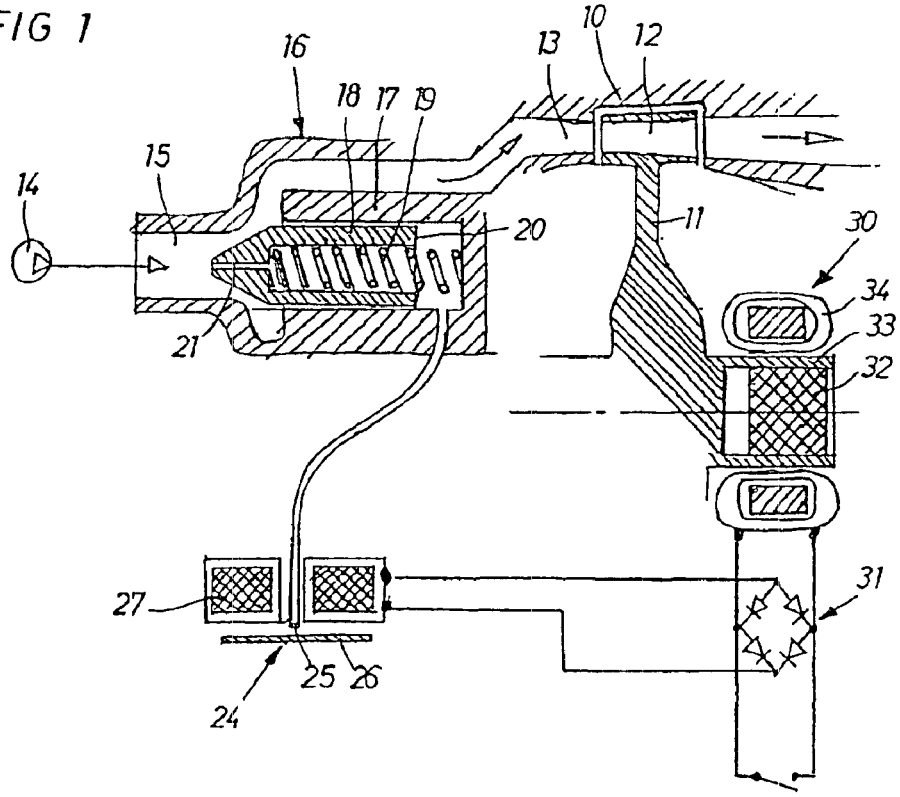
FIG. 1 shows a schematic illustration of the speed governor according to the invention.

The device illustrated in FIG. 1 comprises a pneumatically driven axial flow turbine having a single-stage turbine wheel 11 with a circumferential array of drive blades 12, and a stator 10 provided with a number of air nozzles 13 for directing a motive pressure air flow onto the drive blades 12 of the turbine wheel 11.

Pressure air is supplied to the nozzles 13 from a pressure air source 14 via an inlet passage 15 and a flow control valve 16. The latter comprises a valve element 18 which is movably guided against a spring 19 in a valve housing 17 and disposed in the inlet passage 15 for controlling the air supply to the nozzles 13. To this end, there is provided a pilot circuit comprising an activating surface 20 on the rear end of the valve element 11, a small area opening 21 through the valve element 18 connecting the activating surface 20 with the air inlet passage upstream of the valve 16. The valve element 18 is arranged to be balanced between the air pressure in the inlet passage 15 and the actual pressure acting on the activating surface 20.

The pilot circuit also comprises a bleed-off valve 24 which is connected to the activating surface 20 of the flow control valve 16 and arranged to open up or close, respectively, an air bled-off opening to the atmosphere. The bleed-off valve 24 comprises a small size aperture 25 and a ferrous disc shaped valve element 26 which is operated by an electro-magnet 27 to alternatively open and close the aperture 25. The electro-magnet 27 is operated by an electric voltage delivered by a turbine integrated generator 30 via a rectifier 31.

The generator 30 comprises a permanent magnet 32 rigidly secured to a rear extension 33 of the turbine wheel 11, and a stator including a toroid shaped winding coil 34 surrounding the rear extension 33 and the magnet 32. The output voltage from the winding coil 34 is an alternating current which via the rectifier 31 is transformed to a direct current voltage. The magnitude of the voltage delivered by the generator 30 is directly proportional to the rotation speed of the turbine wheel 11, which means that the activating force developed by the electro-magnet 27 is proportional to the turbine speed as well. The result is that a low turbine speed and, hence, a low output voltage from the generator 30 makes the electro-magnet 27 generate a low lifting force on the disc shaped valve element 26 such that a relatively large bleed-off area is left open. This results in a decreased air pressure acting on the activating surface 20 such that the flow control valve 16 will leave a relatively large air flow area open and, thereby, let through a relatively large air flow to the turbine nozzles 13.

If, however, the turbine speed should increase above a predetermined desired level, the magnitude of the output voltage from the generator 30 will exceed a certain level which will make the electro-magnet 27 lift the valve element 26 to an air bleed-off restricting position, thereby accomplishing an increased pressure acting on the activation surface 20 of the valve element 18. As a result, the flow control valve 16 will restrict the air supply to the turbine nozzles 13, and the turbine speed will be limited to the predetermined desired level.

Figure 2:
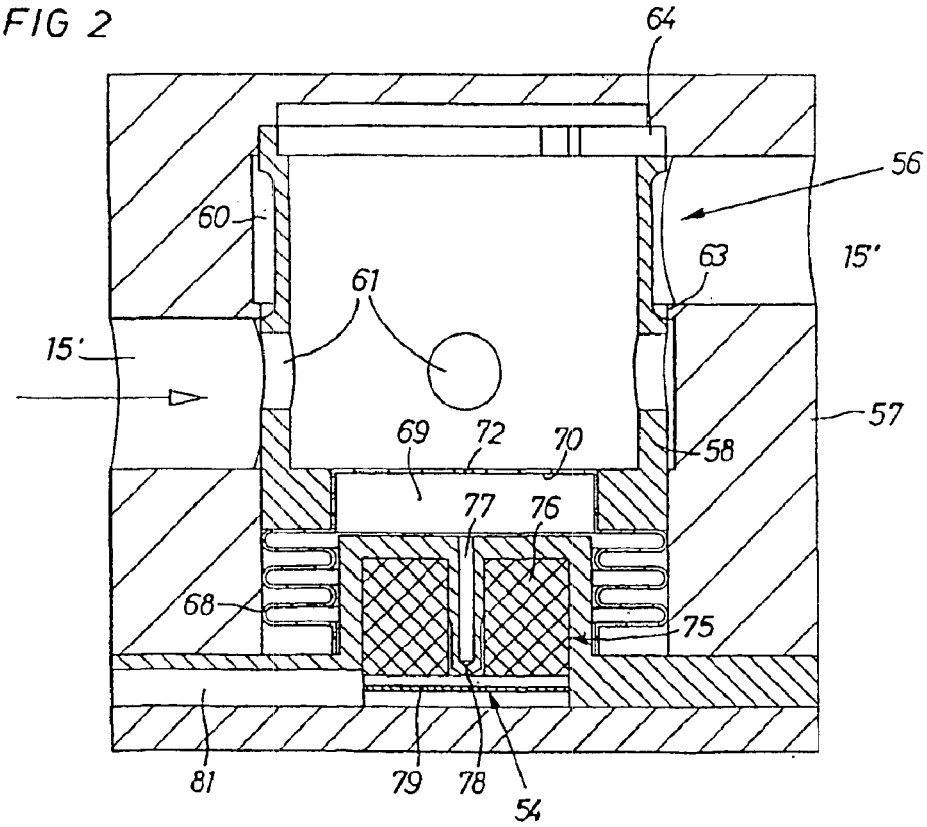
FIG. 2 shows, on a larger scale, the inlet valve and air bleed-off valve according to an alternative embodiment of the invention.

In FIG. 2 there is shown an alternative design of an air inlet flow control valve 56 which is built together with the electro-magnet controlled air bleed-off valve 54. As in the previously described example, the flow control valve 56 comprises a valve element 58 which is movably supported in a valve housing 57 and arranged to control the air flow through the inlet passage 15. In this embodiment of the invention, the valve element 58 is cup-shaped and has an outer waist portion 60 and a number of lateral apertures 61. The waist portion 60 is arranged to communicate air passed an annular shoulder 63 in the valve housing 57, whereas the apertures 61 are arranged to connect the inside with outside of the cup-shaped valve element 58. In the closed position of the flow control valve 56, the outer end of the cup-shaped valve element 58 engages sealingly a seat 64 in the valve housing 57, and the shoulder 63 prevents the waist portion 60 from communicating pressure air from the upstream part 15' of the inlet passage 15 to the downstream part 15".

At its inner end, the valve element 58 is secured to a bellow 68 which encloses an air chamber 69 and an activation surface 70 on which an activation force is applicable on the valve element 58. The chamber 69 communicates constantly with the inside of the cup-shaped valve element 58 via a restricted opening 72. Since the upstream part 15' of the air inlet passage 15 is connected to the pressure air source, the inside area of the valve element 58 as well as the chamber 69 are constantly pressurized.

At the lower end of the valve housing 57, there is mounted a electro-magnet 75 with a winding coil 76 connected to the generator 30. Through the winding coil 76 there extends a central tube with an air passage 77 which at its upper end communicates with the chamber 69 and which at its lower end is provided with a restricted air bleed-off opening 78. The bleed-off opening 78 is controlled by a disc-shaped valve element 79 which is freely movable in a narrow space between the electro-magnet 75 and a cover plate 80. This narrow space communicates with the atmosphere via a radial exhaust opening 81.

In operation, the actual magnitude of the voltage delivered by the generator 30 determines to what extent the electro-magnet 75 shall make the valve element 79 cover or uncover, respectively, the bleed-off opening 78 to thereby adapt the air pressure in the chamber 69 and, hence, the activation force on the valve element 58. At too a low turbine speed the voltage magnitude is below a determined certain level, which results in a low lift force from the electro-magnet 75 on the valve element 79. The result is a relatively unrestricted bleed-off flow through the opening 78, and due to the restricted area of the opening 72, a large bleed-off flow from the chamber 69 results in a lowered activating force on the valve element 58, which means that the latter is displaced in its opening direction providing a larger air inlet flow to the turbine.

In its open condition, the valve element 58 of the flow control valve 56 occupies a position wherein pressure air is able to pass the valve in two ways, namely A) from the upstream part 15' of the inlet passage 15 to the inside the valve element 58, through the apertures 61, out through the outer open end of the valve element 58 past the seat 64 and into the downstream part 15" of the inlet passage 15, and B) from the upstream part 15' of the inlet passage 15, through the waist portion 60 past the shoulder 63 and into the downstream part 15" of the inlet passage 15.

What is claimed is:

1. Speed governor for a pneumatic rotation motor having a rotor (11) and a stator (10) with a pressure air inlet passage (15), comprising an inlet valve (16;56) with a flow controlling valve element (18;58) disposed in said inlet passage (15,15'), and a speed responsive activating device (24;54) operatively connected to said inlet valve (16;58), wherein:

said activating device (24;54) comprises a pneumatic pilot circuit (21,20,25;72,70,77,78) for governing the operation of said inlet valve (16;56), and said pilot circuit (21,20,25;72,70,77,78) comprises:

an activating surface (20;70) on said valve element (18;58), a restricted pressure air supply opening (21;72) communication with said activating surface (20;70), an air bleed-off valve (24;54)communicating with said activating surface (20;70) and comprising an electromagnetic actuator (27;76), and a generator (30) driven by said motor and delivering a motor speed responsive output voltage, said generator (30) is connected to said electro-magnetic actuator (27;76) for accomplishing operation of said bleed-off valve (24;54) and said inlet valve (16;56) in response to said output voltage.

2. Speed governor according to claim 1, wherein said generator (30) comprises a permanent magnet (32) rigidly secured to said motor rotor (11), and a toroid-shaped stator winding (34).

3. Speed governor according to claim 2, wherein said permanent magnet (32) comprises a bar magnet secured in a co-axial extension (33) of said motor rotor (11).

4. Speed governor according to claim 1, wherein said activating surface (70) is formed by a closed bellow (68) associated with said valve element (58), said bellow (68) is supplied with pressure air via said restricted pressure air supply opening (72) and is drained via said bleed-off valve (54) in response to the output voltage of said generator (30).

5. Speed governor according to claim 1, wherein said generator (30) is an alternator, and a rectifier (31) is provided between said generator (30) and said electromagnetic actuator (21;76).

6. Speed governor according to any one of claims 1–5, wherein said bleed-off valve (24;54) comprises an outlet opening (25;78), and a disc shaped valve element (26;79) which is located across said opening (25;78) for controlling the outflow therefrom, and said disc shaped valve element (26;79) is comprised of a ferromagnetic material for co-operation with said electromagnetic actuator (27;76).

7. Speed governor according to any one of claims 1–5, wherein said rotation motor comprises a turbine having a circumferential row of drive blades (12) on said rotor (11), and one or more air inducing drive nozzles (13) in said stator (10) communicating with said air inlet, passage (15;15') via said inlet valve (16;56).

8. Speed governor according to claim 6, wherein said rotation motor comprises a turbine having a circumferential row of drive blades (12) on said rotor (11), and one or more air inducing drive nozzles (13) in said stator (10) communicating with said air inlet passage (15;15') via said inlet valve (16;56).

9. Speed governor according to claim 2, wherein said generator (30) is an alternator, and a rectifier (31) is provided between said generator (30) and said electromagnetic actuator (27;76).

10. Speed governor according to claim 9, wherein said bleed-off valve (24;54) comprises an outlet opening (25;78), and a disc shaped valve element (26;79) which is located across said opening (25;78) for controlling the outflow therefrom, and said disc shaped valve element (26;79) is comprised of a ferromagnetic material for co-operation with said electromagnetic actuator (27;76).

11. Speed governor according to claim 9, wherein said rotation motor comprises a turbine having a circumferential row of drive blades (12) on said rotor (11), and one or more air inducing drive nozzles (13) in said stator (10) communicating with said air inlet, passage (15;15') via said inlet valve (16;56).

12. Speed governor according to claim 10, wherein said rotation motor comprises a turbine having a circumferential row of drive blades (12) or said rotor (11), and one or more air inducing drive nozzles (13) in said stator (10) communicating with said air inlet passage (15;15') via said inlet valve (16;56).

* * * * *